US011027947B2

(12) United States Patent
Lemburg

(10) Patent No.: US 11,027,947 B2
(45) Date of Patent: Jun. 8, 2021

(54) LOAD-FORCE-INDEPENDENT TRIGGERING DEVICE

(71) Applicant: Alfred-Wegener-Institut, Helmholtz-Zentrum fuer Polar- und Meeresforschung, Bremerhaven (DE)

(72) Inventor: Johannes Lemburg, Bremerhaven (DE)

(73) Assignee: ALFRED-WEGENER-INSTITUT, HELMHOLTZ-ZENTRUM FUER POLAR- UND MEERESFORSCHUNG, Bremerhaven (DE)

( * ) Notice: Subject to any disclaimer, the term of this patent is extended or adjusted under 35 U.S.C. 154(b) by 0 days.

(21) Appl. No.: 16/767,661

(22) PCT Filed: Dec. 7, 2018

(86) PCT No.: PCT/DE2018/101001
§ 371 (c)(1),
(2) Date: May 28, 2020

(87) PCT Pub. No.: WO2019/114876
PCT Pub. Date: Jun. 20, 2019

(65) Prior Publication Data

US 2020/0377343 A1 Dec. 3, 2020

(30) Foreign Application Priority Data

Dec. 15, 2017 (DE) ..... 102017130067.8

(51) Int. Cl.
*B66C 1/36* (2006.01)

(52) U.S. Cl.
CPC ..... *B66C 1/36* (2013.01)

(58) Field of Classification Search
CPC ... B66C 1/36; B66C 1/38; F16B 45/02; F16B 45/025
(Continued)

(56) References Cited

U.S. PATENT DOCUMENTS 2,736,599 A * 2/1956 Coffing
2,937,541 A * 5/1960 Barlow
(Continued)

FOREIGN PATENT DOCUMENTS

CN 106829731 A 6/2017
DE 1297998 B 6/1969
(Continued)

*Primary Examiner* — Dean J Kramer
(74) *Attorney, Agent, or Firm* — Leydig, Voit & Mayer, Ltd.

(57) ABSTRACT

A load-force-independent triggering device for a load exerting a force on it that is held in a CLOSED position of the triggering device and released in an OPEN position of the triggering device includes: a housing; a triggering lever, which is connected to a triggering gear via a steering lever, the triggering lever being swivel-mounted on a first housing axis, the triggering gear being swivel-mounted on a second housing axis and the steering lever being swivel-mounted on a steering-lever axis on the triggering lever and on a second steering-lever axis on the triggering gear; a spring device acting on the triggering lever; and a locking device, by which the triggering device is fixed in the CLOSED position. The steering lever has an angular design, and, in the CLOSED position of the triggering device, contacts a first contact surface in the housing.

15 Claims, 2 Drawing Sheets

(58) Field of Classification Search
USPC ..... 294/82.24, 82.3, 82.31, 82.33
See application file for complete search history.

(56) References Cited

U.S. PATENT DOCUMENTS

| | | | | | |
|---|---|---|---|---|---|
| 3,109,676 | A | * | 11/1963 | Mercer | |
| 3,504,407 | A | | 4/1970 | Dawson | |
| 3,578,373 | A | * | 5/1971 | Metz | |
| 3,630,562 | A | * | 12/1971 | Metz | |
| 4,609,219 | A | * | 9/1986 | Go | |
| 6,654,990 | B2 | * | 12/2003 | Liu | |
| 8,998,280 | B1 | * | 4/2015 | McMillan | B63B 21/08 294/82.33 |
| 2013/0042444 | A1 | | 2/2013 | Mischnick et al. | |

FOREIGN PATENT DOCUMENTS

| | | | |
|---|---|---|---|
| DE | 102010010161 | B4 | 4/2012 |
| JP | S61295993 | A | 12/1986 |

* cited by examiner

LOAD-FORCE-INDEPENDENT TRIGGERING DEVICE

CROSS-REFERENCE TO PRIOR APPLICATIONS

This application is a U.S. National Phase application under 35 U.S.C. § 371 of International Application No. PCT/DE2018/101001, filed on Dec. 7, 2018, and claims benefit to German Patent Application No. DE 10 2017 130 067.8, filed on Dec. 15, 2017. The International Application was published in German on Jun. 20, 2019 as WO 2019/114876 under PCT Article 21(2).

FIELD

The invention relates to a load-force-independent triggering device for a load exerting a force on it that is held in a CLOSED position of the triggering device and released in an OPEN position of the triggering device, comprising a housing and a triggering lever, which is connected to a triggering gear via a steering lever, wherein the triggering lever is swivel-mounted on a first housing axis, the triggering gear is swivel-mounted on a second housing axis, and the steering lever is swivel-mounted on the triggering lever on a first steering-lever axis and swivel-mounted on the trigger gear on a second steering-lever axis, as well as comprising a spring device acting on the triggering lever, and a locking device, by means of which the triggering device is fixed in the CLOSED position.

A triggering device is used to separate a load from a device, such as a crane or a gantry for example. A load-force-independent triggering device separates the load from the device regardless of the force that the load exerts on the triggering device prior to separating. In many devices, it is known for a heavy load to block the triggering device because the moveable parts for opening no longer move under the load force. Only an elimination of the load force then allows for the triggering device to open. However, particularly in the case of very heavy loads, this is not possible, or is only possible with a very substantial amount of effort. In the case of load-force-independent triggering devices, the load force is not exerted onto the opening components so that they can reliably open even under the influence of the load force on the triggering device itself. Such load-force-independent triggering devices are known, for example, for gliders (so-called "towing couplings"). Also, in underwater areas, load-force-independent triggering devices are of a great advantage because large loads must often be sunken in water subject to their downforce or have to be hauled up being subject to their buoyancy force in the water.

BACKGROUND

The prior art closest to the invention is disclosed in DE 1 297 998 A (cf FIG. 2 in particular). It describes a tow coupling for aircraft that performs triggering irrespective of the force exerted on the coupling by a towed aircraft, usually a glider. In a CLOSED position of the triggering device, the aircraft is held in the air via a towing cable, in an "OPEN position" of the triggering device, the towing cable and thus the aircraft is released. The well-known load-force-independent triggering device comprises a housing on which a rotatable segment and a lever are arranged on a first housing axis. Segment and lever form a triggering lever. The first housing axis is fixed in the housing in a stationary manner.

Furthermore, a triggering gear is swivel-mounted on a second housing axis. The second housing axis is also fixed in the housing in a stationary manner. The triggering lever and the triggering gear are articulately jointed to each other by means of a steering lever. For this purpose, the steering lever is swivel-mounted on a first steering-lever axis on the triggering lever and swivel-mounted on the triggering gear on a second steering-lever axis. The steering lever is designed in the form of a straight lug; the first and second steering-lever axes are each arranged at one end of the steering lever. They are not fixed in the housing and move together with the steering lever. The steering lever is only guided by the triggering lever and triggering gear, which can lead to undefined and indissoluble positions of the steering lever in the housing under extreme conditions.

The triggering lever (or the rotatable segment) and the steering lever together form an interlocking system. They are in their dead-center position so that they block each other and a self-locking is provided. Due to the interlocking system, the force acting by the load is redirected in the triggering device and no longer directly affects the locking. For triggering, a relatively low, load-force-independent force must now be applied, which releases interlocking system. For this purpose, a spring device is provided in the known triggering device, which acts on the triggering lever (or on the rotatable segment). By adjusting the spring force, the degree of interlocking or self-locking can be adjusted. This determines the triggering force. When disengaging the interlocking system or retracting the triggering lever and the straight steering lever, the triggering gear is simultaneously actuated. The load is then released by rotating around the second housing axis. Furthermore, the known triggering device has a locking device in the form of a manually actuated eccentric lever, by means of which the triggering device is fixed in the CLOSED position. The triggering of the known triggering device is carried out either manually by actuating the triggering lever or automatically by force-induced shearing of a plastic release pin, which locks the triggering device in the CLOSED position. For this purpose, the plastic pin blocks a spring-loaded mating gear. However, both triggering mechanisms are not suitable for also reliably triggering the triggering device remotely and under the disturbing influence of external irregular and partially very strong force effects.

Force-independent triggering devices for underwater use are known, for example, from U.S. Pat. No. 3,504,407 A and DE 10 2010 010 161 B4. However, these work without an interlocking system and guide the load forces around the trigger elements across massive structural components.

SUMMARY

In an embodiment, the present invention provides a load-force-independent triggering device for a load exerting a force on it that is held in a CLOSED position of the triggering device and released in an OPEN position of the triggering device, comprising: a housing; a triggering lever, which is connected to a triggering gear via a steering lever, the triggering lever being swivel-mounted on a first housing axis, the triggering gear being swivel-mounted on a second housing axis and the steering lever being swivel-mounted on a steering-lever axis on the triggering lever and on a second steering-lever axis on the triggering gear; a spring device configured to act on the triggering lever; and a locking device, by which the triggering device is fixed in the CLOSED position, wherein the steering lever has an angular design, and, in the CLOSED position of the triggering device, is configured to contact a first contact surface in the housing and, in the OPEN position of the triggering device, is configured to contact a second contact surface in the housing, wherein the two steering-lever axes are positioned at the first contact surface of the steering lever immediately before a self-locking dead-center position towards the first housing axis and on the second contact surface of the steering lever outside of dead-center position, and wherein the spring device comprises a tension spring, which is arranged between the triggering lever and the triggering gear and is configured to exert a force on the triggering lever in a direction of the OPEN position of the triggering device in the CLOSED position of the triggering device.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
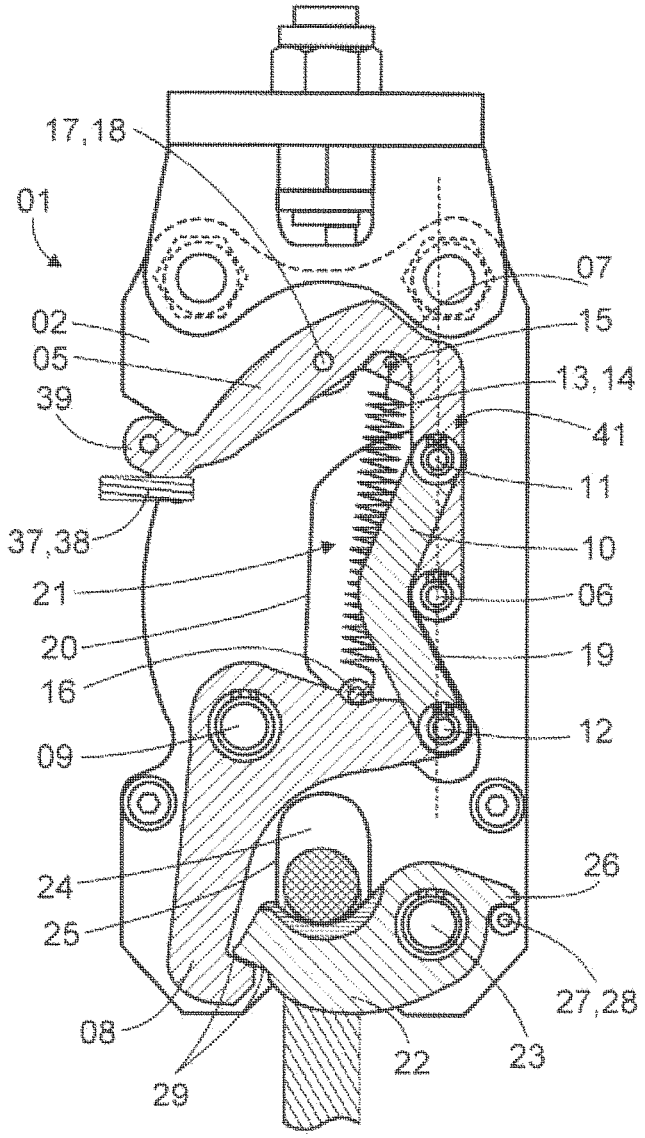
FIG. 1 shows the triggering device in the CLOSED position.

In an embodiment, the present invention further develops the generic load-force-independent triggering device in such a way that the triggering device can also be reliably triggered remotely and under the irregular influence of external force effects, but without additional external force application, wherein undefined positions of the steering lever in the housing are absolutely to be avoided. Thereby, all the advantages of a load-force-independent triggering device should be retained.

According to the invention, in the load-force-independent triggering device, the steering lever has an angular design and, in the CLOSED position of the triggering device, contacts a first contact surface in the housing and, in the OPEN position of the triggering device, contacts a second contact surface in the housing, wherein the two steering-lever axes are positioned on the first surface of the steering lever immediately before a self-locking dead-center point in relation to the first housing axis and at the second contact surface of the steering lever outside the dead-center position, and that the spring device is designed as a tension spring, which is arranged between the triggering lever and the triggering gear and, in the CLOSED position of the triggering device, exerts a force on the triggering lever in the direction of the OPEN position of the triggering device.

In the triggering device according to the invention, the steering lever has an angular design and is guided between two contact surfaces, wherein the steering lever contacts the first contact surface in the CLOSED position and contacts the second contact surface in the OPEN position. The steering lever, which does not occupy a fixed axis in the housing but is only articulately joined to the triggering lever and the triggering gear thus occupies only firmly defined positions in the triggering device. This increases triggering reliability. The defined position is still supported by the angularity of the steering lever, which is advantageously attached to a correspondingly angular contact surface at least in the CLOSED position. Vertical displacements are reliably avoided. Furthermore, the angularity of the steering lever is of an advantage for bringing the two steering-lever axes on the steering lever in the CLOSED position of the triggering device with the first housing axis into a position immediately before their dead-center position. Due to the angularity, the two steering-lever axes can be positioned above and below the first housing axis. Thereby, the steering lever is deliberately placed very close to the dead-center position so that it always strives to get out of this position into the direction of the OPEN position. Nevertheless, by positioning the steering lever in relation to the housing in approximately dead-center position, it is achieved that attacking load forces do not act on the steering lever and, if necessary, this. around it into the housing. The trigger movement of the steering lever is still supported by the provided tension spring between the triggering lever and the triggering gear, which is arranged slightly obliquely. However, premature or unintentional triggering is prevented by the locking device, by means of which the triggering device is reliably fixed in the CLOSED position. When the locking device is then unlocked for opening, the triggering device immediately opens automatically and without any further force input from the outside since the energy stored in the tension spring flips over the steering lever in an accelerated manner, which is located just before the dead-center position and has the tendency to flip over. Due to the tendency of the steering lever to open automatically, in conjunction with the tension spring, any obstructions of the triggering device, such as rust, dirt, deposits (especially in underwater applications) and friction, can be safely overcome. These measures therefore provide a simple but particularly reliable load-force-independent trigger with the triggering device according to the invention, which also reliably triggers the release of heavy loads under adverse environmental conditions and does not undefined positions.

The reliability of the triggering by the defined position of the steering lever is further improved in the invention if, being preferred and favourable, the two contact surfaces for the steering lever are formed by a closed contour in the housing. This also gives the contact surfaces a precisely defined position and stability. Furthermore, such a contour can be produced in a housing wall relatively easily by means of milling. For a simple attachment of the tension spring to the triggering lever, it is still preferred and favourable if the triggering lever has an A (trapezoidal) shape. The tension spring can then be attached to the preferably flattened tip of the triggering lever without bending the triggering lever. The locking device can then engage directly next to the triggering lever.

The triggering gear can have a hook in its lower area, into which, for example, a cable for the load can be hung. The securing of the cable on the hook can be done, for example, via the housing as a counter bearing. However, it is favourable and preferred for the invention if a mating gear is provided, which is swivel-mounted on a third housing axis and forms a closed eyelet, in which the load can be held, in the CLOSED position of the triggering device along with the triggering gear and the housing. Then, the suspended load must not slip off a hook. Instead, the holding surface is completely dissolved when opened, ensuring that the load is reliably released. This is particularly advantageous if it is a heavy load, in which the cable would long hang on an opening hook due to the generated stiction of the adhesive. For the triggering device with the invention, a heavy-duty version with a load capacity of up to 3 t can be preferably and favourably provided. Furthermore, it is preferred and favourable if, in the case of an openable construction consisting of a triggering gear and mating gear with the housing as a counter bearing, the housing has a receptacle for a load cable. It is therefore preferred and favourable if the housing has a one-sided open elongated hole to form the eyelet. The cable can then be inserted into this elongated hole and is reliably guided there without a great level of lateral play. In order for the mating gear to take a defined position in the CLOSED position of the triggering device, it is preferred and favourable if the mating gear has a nib, which is mounted at an end stop in the housing in the CLOSED position of the triggering device. Furthermore, preferably and favourably, the triggering gear and the mating gear can have sections that are attached to each other in the CLOSED position of the triggering device. All these measures are used to reliably secure the load cable in the CLOSED position of the triggering device.

In the load-force-independent triggering device with the invention, the CLOSED position is held exclusively by the action of the locking device. Therefore, this is of particular importance. It is therefore preferred and favourable in the case of the invention if the locking device comprises an electromagnetic trigger with an axially moveable release pin, by means of which the triggering lever is fixed in the housing in the CLOSED position of the triggering device, wherein the axially moveable release pin is arranged orthogonally to the triggering lever. An electromagnetic trigger (solenoid actuator) is a standard commercial component. The release pin is held by the anchor of the electromagnet in the CLOSED position and locked there by a spring. The release pin engages through a hole into the triggering lever. When triggered, the electromagnet is electrically actuated and causes the release pin to be retracted into the inside of the trigger so that the triggering lever is released. Under the attacking spring force of the tension spring (especially in the formation of a spiral spring, i.e. coil spring), the triggering lever is pulled downwards and takes the steering lever with it. Being preferred and favourable, the electromagnetic trigger or the axially moveable release pin is arranged orthogonally to the triggering lever. This prevents accidental external force effects on the triggering device from inadvertently actuating the trigger. Inadvertent forces in the direction of the axially moveable release pin can still occur because the release pin is quite light and is held in position by a small spring. The release pin is reliably and consciously shifted axially only by actuating the electromagnet, wherein the triggering force is then greater than the resuming spring force. In order to achieve an increased level of reliability, particular in transport operations in which a triggering is to be avoided in any case, it is preferred and favourable in the case of the invention if the locking device comprises an additional safeguard, by means of which the triggering lever is fixed in the housing in the CLOSED position of the triggering device. Thereby, the additional safeguard can preferably and favourably be designed as a cotter pin. This is a transport safeguard that must be removed manually. Remote triggering is not provided.

In the case of the triggering device according to the invention, it can furthermore be provided as preferred and favourable modifications can be provided that a grip lug is arranged on the triggering lever for manual positioning of the triggering lever in the OPEN position of the triggering device. This improves the manual handleability of the triggering device. No tools are needed to transfer the system to the CLOSED position. Furthermore, it is preferred and favourable for the easy handling of the force-independent triggering device according to the invention if a suspension is arranged at the upper end. This can be, for example, a rod connected to a gantry, or a shackle connected to a cable.

It was already mentioned at the beginning that the triggering device with the invention is particularly resistant to incidental load surges from the outside. Such effects can occur when the triggering device is used in underwater areas. Here, it may be exposed to strong waves or currents or ship movements. The triggering device can be used, in particular, on a research vessel and can be used to output a measuring apparatus. Self-driving underwater vessels (landers) weighing more than 2 t can also be used. It is mandatory to ensure that no triggering takes place above the water level in order to prevent damage to the measuring apparatus when hitting the water surface. The release can only take place in the water body (the measuring apparatus then sinks further) or only after the measuring apparatus has been set up on the water floor. Particularly in deep-sea operations, it is therefore preferred and favourable if a seawater-resistant material version is provided for the load-force-independent triggering device. In particular, stainless steels and plastics are used.

Such underwater operations can cause the triggering device to be lowered several hundred or thousand metres deep in the water. At such depths, therefore, the increase in hydrostatic pressure must be taken into account. In particular, components with airspaces must be protected. The invention relates to the locking device. The electromagnetic trigger must be protected. For this purpose, it can be integrated into a pressure-resistant housing. However, it is preferred and favourable to form the electromagnetic trigger pressure-neutral. For this purpose, this is filled into a transparent plastic cylinder that can be closed with two covers and filled completely with a pressure fluid, mostly pressure oil. For volume compensation, a flexible pressure equalization element associated with the ambient pressure (i.e. also with the ambient medium water) is inserted into the plastic cylinder. This can be preferably and favourably be a pressure-resistant tubular bag made of PVC, as it is used in the medical sector for fluid collection. The hose bag has an integrated supply hose that allows the seawater to penetrate its interior and is easily adaptable to any volume. Further details on the use of such bags and their advantages can be found in the older German applications 102017119115.1 (pressure-neutral battery) and 102017119158.5 (pressure-neutral electric motor). Further details about the invention and its embodiments can be found in the exemplary embodiments described below.

A load-force-independent triggering device 01 for underwater application is shown in FIG. 1. The materials used are therefore seawater-resistant. The triggering device 01 is in the CLOSED position, in which a load, for example an OFOS (Ocean Floor Observation System) in a lowering frame, is held, for example on a crane on a research vessel. OFOS and lowering frames have a weight of several hundred kilograms, which act on the triggering device 01 as a whole but not on the immediate triggering area. Rather, the force is guided along it by the triggering device 01. Thus, the triggering device 01 can be triggered independently of the acting load force by applying only a low level of triggering force.

Figure 3:
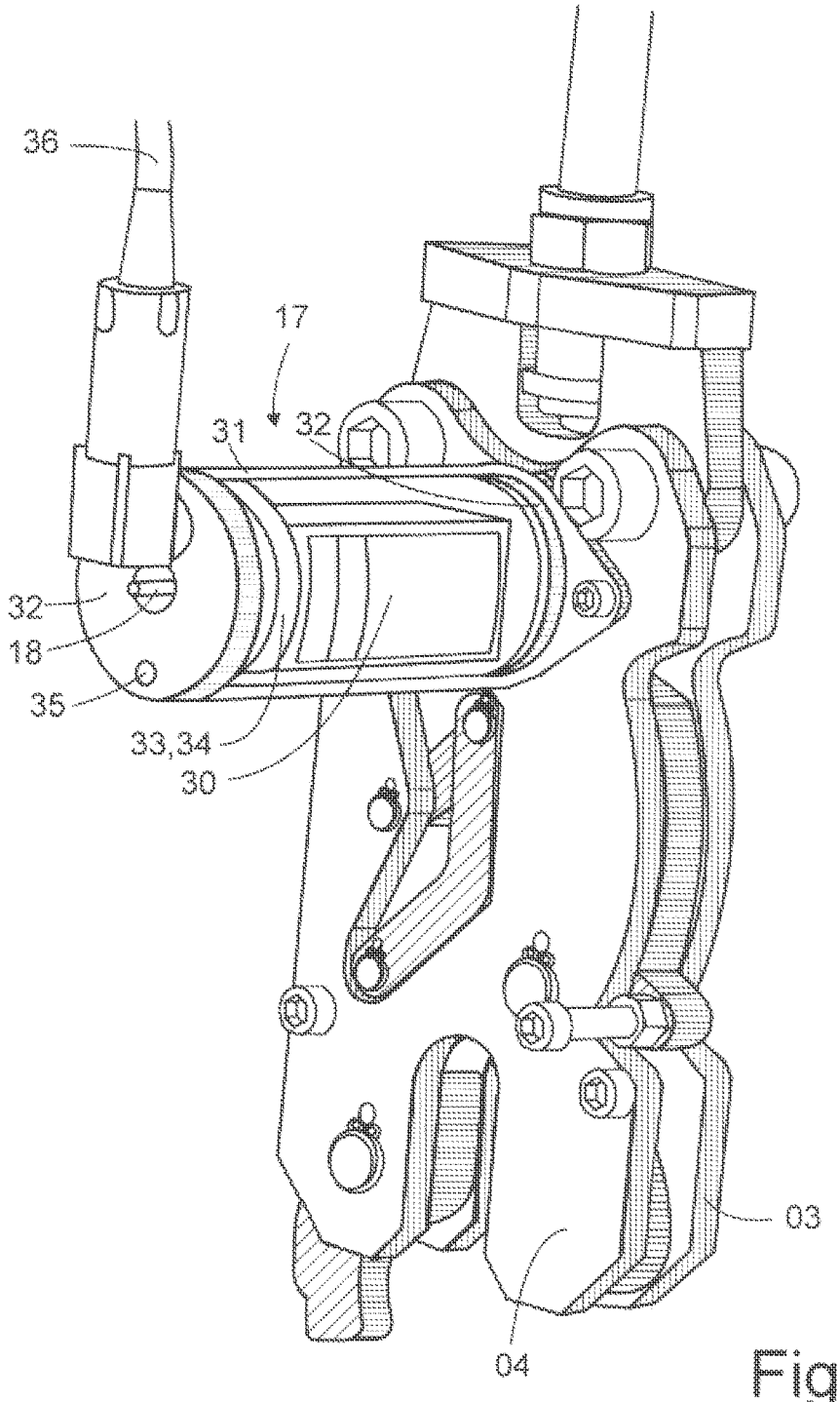
FIG. 3 shows the triggering device from behind with the locking device.

The triggering device 01 comprises a housing 02, which is screwed together in the shown exemplary embodiment consisting of two structured steel sheets 03, 04 (cf. FIG. 3). This has the advantage that the further, in particular, moveable components can be arranged between the two steel sheets 03, 04 and are thus protected from external influences. The triggering device 01 further comprises a triggering lever 05, which is swivel-mounted on a stationary first housing axis 06. In the exemplary embodiment shown, the triggering lever 05 is in the shape of an A, wherein it has a flattened top edge 07. Furthermore, the triggering device 01 comprises a triggering gear 08, which is swivel-mounted on a stationary second housing axis 09.

Triggering lever 05 and triggering gear 08 are articulately joined to each other via a steering lever 10. In the exemplary embodiment shown, the housing 02 consists essentially of the two steel sheets 03, 04 arranged in parallel to each other. The triggering lever 05 and the triggering gear 08 work between the two steel sheets 03, 04. In order to prevent obstruction with the steering lever 10, it consists of two parallel parts, one part of which is in the steel sheet 03 and the other part in the steel sheet 04 in contour 21 (see below). If the 'steering lever 10' is referred to below, it is the steering lever shown 10 consisting of two parts. However, a single-piece design is also possible without further ado.

The steering lever 10 is rotatably connected to the triggering lever 05 via a variable first steering-lever axis 11 and to the triggering gear 08 via a variable second steering-lever axis 12. In the CLOSED position, the two steering-lever axes 11, 12 and the first housing axis 06 are arranged immediately before their dead-center position 41 to each other (dashed line in FIG. 1, which shows that the second steering-lever axis 12 somewhat deviates from the linear connection between housing axis 06 and the first steering-lever axis 11). By this arrangement, a far-reaching interlocking system, consisting of triggering lever 05 and steering lever 10, is achieved, which ensures that a load force occurring at the triggering gear 08 is not transferred to the triggering lever 05. Nevertheless, the steering lever 10 is not fixed at the dead-center point but has the tendency to move in the direction of the OPEN position. This is supported by a spring device 13 in the form of a tension spring 14, which is arranged between the top edge 07 of the triggering lever 05 and the triggering gear 08. In this case, the tension spring 14 is positioned somewhat obliquely, meaning that an upper attachment point 15 of the tension spring 14 is offset vertically to a lower attachment point 16. The tension spring 14 (in the exemplary embodiment shown is a simple standardized, commercially available coil spring) is clamped in the CLOSED position and has the tendency to pull the triggering lever 05 downwards. This is prevented by a locking device 17 with an axially moveable release pin 18, which engages from behind through an opening into the triggering lever 05 (cf. FIG. 3) and fixes it in the CLOSED position. If the fixation is eliminated, the tension spring 14 pulls the steering lever 11 directly into the OPEN position, which leads to an immediate opening of the triggering gear 08.

The steering lever 10 is designed to be angular. In the exemplary embodiment shown, it is bent in its center at an obtuse angle of approx. 120°. In the CLOSED position, it contacts a first contact surface 19 in housing 02. Its position is thus precisely defined. Thereby, the first contact surface 19 is also shaped as an obtuse angle. In the OPEN position, on the other hand, the steering lever 10 is mounted on a second contact surface 20 in the housing 02 (cf. FIG. 2). This position is also clearly defined. The second contact surface 20 is also shaped as an obtuse angle. By means the defined system of the steering lever 10 in the CLOSED position on the first contact surface 19, the above-mentioned positioning of the steering lever 10 immediately before the dead-center position 41 is precisely achieved and adhered to. By means of the defined system of the steering lever 10 in the OPEN position on the second contact surface 20, the steering lever 10 is reliably positioned outside the dead-center position 41, whereby a re-transfer to the CLOSED position is accordingly facilitated.

In the FIG. 1, it can still easily be recognized that the two contact surfaces 19, 20 are formed by a contour 21 in the housing 02. This is inserted into both steel sheets 03, 04 (cf. FIG. 3) and has the closed shape of a boomerang. In the CLOSED position of the triggering device 01, the first steering-lever axis 11 contacts the first contact surface 19 in the upper area of contour 21. In the CLOSED position of the triggering device 01, the second steering-lever axis 12 contacts the second contact surface 20 in the lower area of contour 21 (cf. FIG. 2).

Furthermore, in the FIG. 1 in the lower area of the triggering device 01 a mating gear 22 shown, which is swivel-mounted on a stationary third housing axis 23. In the CLOSED position, the mating gear 22 forms a closed eyelet 24, in which a load can be held (for example via a cable), along with the triggering gear 08 and the housing 01. For the formation of the eyelet 24 and for the guided insertion of the cable, the housing 02 or the two steel sheets 03, 04 has a one-sided open elongated hole 25. For a defined position of the mating gear 22 in the CLOSED position, this has a nib 26 which presses against an end stop 27 in the housing 02. Since the mating gear 22—as well as triggering lever 05, steering lever 10 and triggering gear 08—is arranged in the middle of the housing 02 between the two steel sheets 03, 04, the end stop 27 can be formed in the form of a small shaft 28 between the two steel sheets 03, 04. For the secure locking and holding of the cable of the load in the CLOSED position, the triggering gear 08 and the mating gear 22 also have sections 29, by means of which they securely contact each other.

In the FIG. 1, the locking device 17 can only be recognized in the area of the release pin 18; FIG. 3 shows further details with insertion. Here it is shown that the locking device 17 is arranged on the back side of the triggering device 01 and does so orthogonally to this (the release pin 18 is arranged orthogonal to the triggering lever 05). Due to this right-angled arrangement to each other, false triggering due to undesirable force effects, which can occur especially when immersed in the water surface, are reliably avoided. The locking device 17 comprises an electromagnetic trigger 30 (e.g. solenoid actuator Intertec® ITS-LS-4035-D-12 VDC), in which an actuator (anchor with or only release pin 18) is moved back and forth via a magnetic field within a magnetic coil linearly, i.e. in the direction of the axis. In the CLOSED position, the release pin 18 engages through the housing 02 or the rear steel sheet 04 into a hole in the triggering lever 05 and fixes it in position. A spring on the trigger 30 keeps the anchor locked in the CLOSED position. In the OPEN position, the release pin 18 is retracted and the triggering lever 05 is released.

For underwater use, it is of great advantage if the locking device 17 is designed to be pressure-neutral. For this purpose, in the shown exemplary embodiment, the electromagnetic trigger 30 is arranged in a transparent plastic cylinder 31 (polycarbonate), which is sealed by two covers 32 in a pressure-tight manner. The plastic cylinder 31 and trigger (to the extent it has openings) are filled with a pressure oil (e.g. white oil or silicone). Due to the transparency of the plastic cylinder 31, inside of it can be more easily inspected. In the plastic cylinder 31, a pressure equalization element 33 is still arranged, the volume of which can be changed depending on the pressure. In the chosen exemplary embodiment, this is a simple tubular bag 34 (PVC), as it is known from the medical sector (infusion bags, urine bags, secretion bags). Via an integrated supply hose 35, the interior of the hose bag 34 is filled with the ambient medium, for example, with water from the hydrostatic pressure column when used underwater that a pressure equalization takes place between inside and outside and pressure neutrality prevails. The anchor of the trigger 30 protrudes from behind out of the cover 32 so that the pressure oil volume remains constant during actuation and around the trigger 30, if necessary, it can be pre-tensioned by hand (insert the anchor) or checked that locking takes place properly (no anchor is in front). Furthermore, an electrical supply line 36 for actuating the trigger 30 is shown in FIG. 3.

Another part of the locking device is shown in the FIG. 1. This is an additional safeguard 37, in the shown exemplary embodiment in the form of a cotter pin 38, by which the triggering lever 05 is securely fixed in the CLOSED position of the triggering device 01 in the housing 02. In the FIG. 1 is also shown a grip lug 39 at the triggering lever 05, which is used to transfer the triggering lever from the OPEN position (cf. FIG. 2) to the CLOSED position again.

Figure 2:
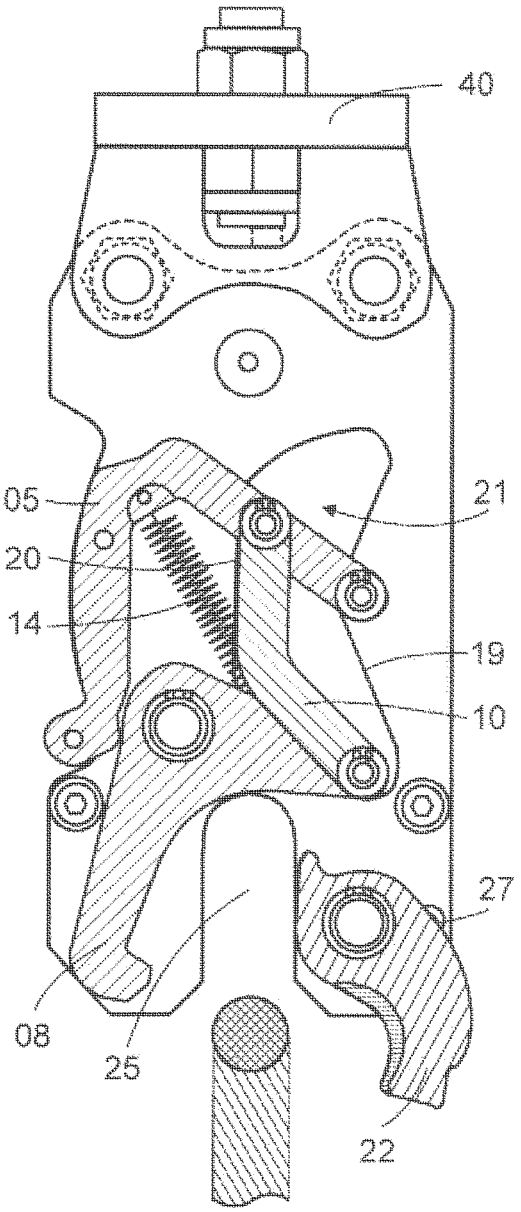
FIG. 2 shows the triggering device in the OPEN position.

The OPEN position of the triggering device 01 is shown in FIG. 2. Most of the components have already been associated with the FIG. 1 explained. The strongly changed positions of the triggering lever 05 and the steering lever 10 as well as the tension spring 14 are clearly apparent. The triggering gear 08 has moved only a little but released the mating gear 22. The triggering device 01 is open; the cable could slide out of the elongated hole 25. The mating gear 22 is again at the end stop 27 and does not block the elongated hole 25.

Furthermore, in FIG. 2 at the upper end of the triggering device 01, a suspension 40 is shown, at which a coupling rod or a hook (not shown further) for fastening/suspension of the triggering device on a gantry or a crane can be arranged.

Overall, with the triggering device 01 according to the invention, a simple but particularly reliable and easy-to-use device is provided, using which very large loads up to 3 t can be reliably held and reliably released even under particularly difficult environmental conditions, especially in underwater areas.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

REFERENCE LIST

01 load-force-independent triggering device
02 housing
03 first steel sheet from 02
04 second steel sheet from 02
05 triggering lever
06 first housing axis (stationary)
07 top edge of 05
08 triggering gear
09 second housing axis (stationary)
10 steering lever
11 first steering-lever axis (variable location)
12 second steering-lever axis (variable location)
13 spring device
14 tension spring as 13
15 upper strike point of 14
16 lower strike point of 14
17 locking device
18 release pin
19 first contact surface for 10 in 02
20 second contact surface for 10 in 02
21 contour with 19, 20
22 mating gear
23 third housing axis (stationary)
24 eyelet
25 elongated hole in 02
26 nib at 22
27 end stop for 22
28 shaft as 27
29 section at 08, 22
30 trigger for 18
31 plastic cylinder for 30
32 cover from 31
33 pressure equalization element
34 tubular bags as 33
35 supply hose from 34
36 electric supply line for 30
37 additional safeguard
38 cotter pin as 37
39 grip lug
40 suspension
41 dead-center position

The invention claimed is:

1. A load-force-independent triggering device for a load exerting a force on it that is held in a CLOSED position of the triggering device and released in an OPEN position of the triggering device, comprising:

a housing;

a triggering lever, which is connected to a triggering gear via a steering lever, the triggering lever being swivel-mounted on a first housing axis, the triggering gear being swivel-mounted on a second housing axis and the steering lever being swivel-mounted on a steering-lever axis on the triggering lever and on a second steering-lever axis on the triggering gear;

a spring device configured to act on the triggering lever; and a locking device, by which the triggering device is fixed in the CLOSED position, wherein the steering lever has an angular design, and, in the CLOSED position of the triggering device, is configured to contact a first contact surface in the housing and, in the OPEN position of the triggering device, is configured to contact a second contact surface in the housing, wherein the two steering-lever axes are positioned at the first contact surface immediately before a self-locking dead-center position towards the first housing axis and on the second contact surface outside of dead-center position, and wherein the spring device comprises a tension spring, which is arranged between the triggering lever and the triggering gear and is configured to exert a force on the triggering lever in a direction of the OPEN position of the triggering device.

2. The load-force-independent triggering device according to claim 1, wherein the two contact surfaces for the steering lever comprise a closed contour in the housing.

3. The load-force-independent triggering device according to claim 1, wherein the triggering lever is shaped like an A.

4. The load-force-independent triggering device according to claim 1, further comprising a mating gear, which is swivel-mounted on a third housing axis and, in the CLOSED position of the triggering device forms a closed eyelet, in which the load is holdable, along with the triggering gear and the housing.

5. The load-force-independent triggering device according to claim 4, wherein the housing has a one-sided open elongated hole to form the eyelet.

6. The load-force-independent triggering device according to claim 4, wherein the mating gear has a nib which is mounted at an end stop in the housing in the CLOSED position of the triggering device.

7. The load-force-independent triggering device according to claim 4, wherein the triggering gear and the mating gear have sections which are attached to each other in the CLOSED position of the triggering device.

8. The load-force-independent triggering device according to claim 1, wherein the locking device comprises an electromagnetic trigger with an axially moveable release pin, by which the triggering lever is fixed in the CLOSED position of the triggering device in the housing, and wherein the axially moveable release pin is arranged orthogonally to the triggering lever.

9. The load-force-independent triggering device according to claim 8, wherein the load-force-independent triggering device comprises a seawater-resistant material for an underwater use.

10. The load-force-independent triggering device according to claim 9, wherein the electromagnetic trigger is configured so as to be pressure-neutral.

11. The load-force-independent triggering device according to claim 10, wherein the pressure-neutral electromagnetic trigger has a pressure-resistant tubular bag as pressure equalization element.

12. The load-force-independent triggering device according to claim 1, wherein the locking device comprises an additional safeguard, by which the triggering lever is fixed in the housing in the CLOSED position of the triggering device.

13. The load-force-independent triggering device according to claim 12, wherein the additional safeguard comprises a cotter pin.

14. The load-force-independent triggering device according to claim 1, wherein a grip lug configured to manually position the triggering lever is arranged on the triggering lever in the OPEN position of the triggering device.

15. The load-force-independent triggering device according to claim 1, wherein a suspension is arranged at an upper end of the triggering device.

* * * * *